United States Patent [19]

Bausch et al.

[11] 4,250,479

[45] Feb. 10, 1981

[54] TRANSFORMER BOBBIN ASSEMBLY

[75] Inventors: James F. Bausch; Burkhard A. Brandt; Craig A. Sanford, all of Corvallis, Oreg.

[73] Assignee: Hewlett-Packard Company, Palo Alto, Calif.

[21] Appl. No.: 28,486

[22] Filed: Apr. 9, 1979

[51] Int. Cl.[3] ..... H01F 27/30

[52] U.S. Cl. ..... 336/208; 242/118.41

[58] Field of Search ..... 336/198, 208, 192; 242/118.41; 310/194

[56] References Cited

U.S. PATENT DOCUMENTS 2,375,309 5/1945 McCoy ..... 336/192 X

FOREIGN PATENT DOCUMENTS 2006736 8/1971 Fed. Rep. of Germany ..... 336/208
2311612 9/1973 Fed. Rep. of Germany ..... 336/208
1250827 10/1971 United Kingdom ..... 336/198

*Primary Examiner*—Thomas J. Kozma
*Attorney, Agent, or Firm*—Allston L. Jones; Edward Y. Wong

[57] ABSTRACT

A transformer bobbin assembly having a first bobbin piece dimensioned to accommodate at least one additional bobbin piece within its central cavity. Each bobbin piece having a pair of flanges, one at each end and perpendicular to its central cavity, defining a channel around the outer surface of the bobbin piece to accommodate a single coil winding. The surface distance over the flange of the larger bobbin piece from the end of its cavity to the top of the flange plus the thickness of this flange is selected to provide at least the minimum creepage and clearance distances required by a selected industrial safety standard.

If two bobbin pieces, each being fully insertable within the interior cavity of the larger bobbin piece, are utilized, the necessary creepage and clearance distances between the coil wound on each of these nesting bobbin pieces is provided by a web within the cavity of the larger bobbin piece. This web is centrally located within and parallel to the flanges of the larger bobbin piece. In this configuration the larger bobbin piece is wide enough to fully accommodate both of the nesting bobbin pieces. The creepage and clearance distances here is twice the width plus the thickness of the web. Additionally, the outer flange of each of the nesting bobbins define a pair of lead wire holes for maintaining the desired creepage and clearance distances between each of these leads and the core of the finished transformer as required by the various industry safety standards.

1 Claim, 6 Drawing Figures

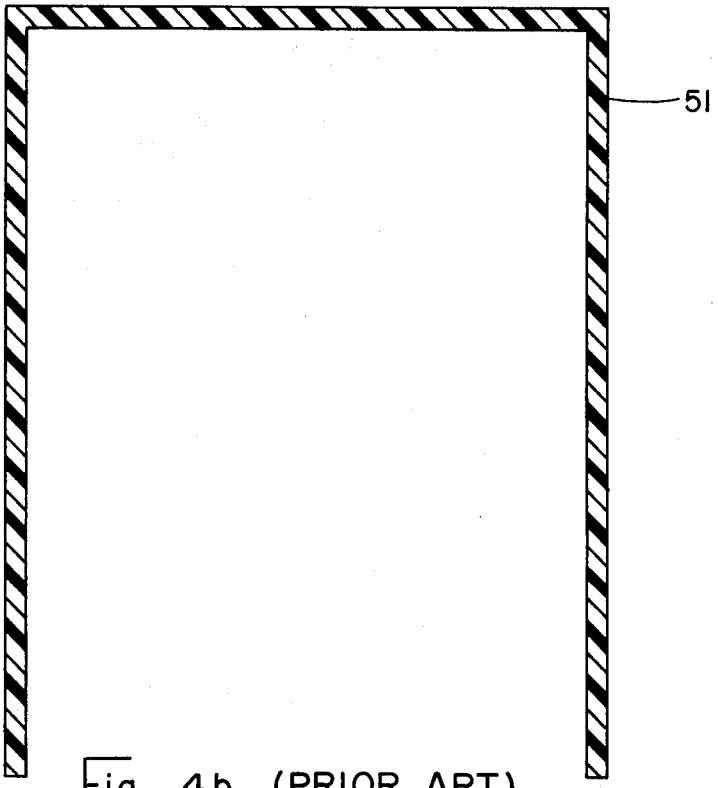
Fig. 4b (PRIOR ART)
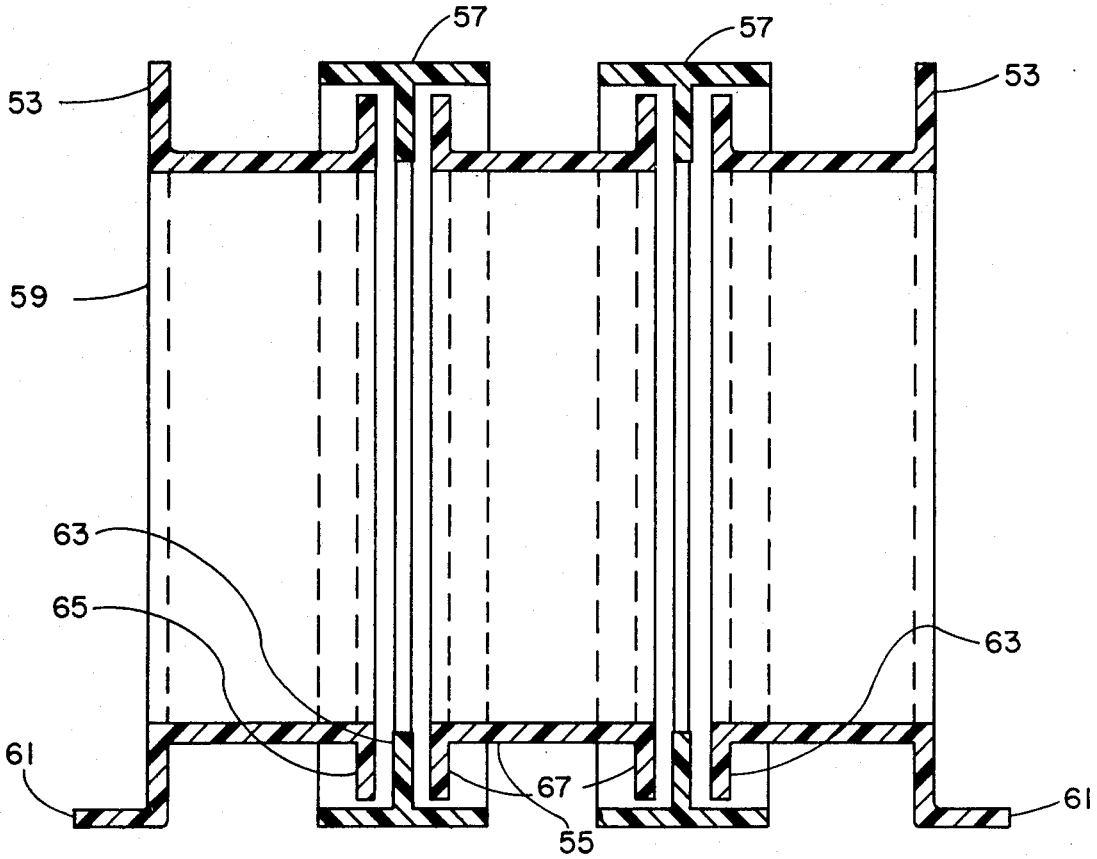

TRANSFORMER BOBBIN ASSEMBLY

BACKGROUND AND SUMMARY OF THE INVENTION

This invention is concerned generally with bobbin type transformers, and, more particularly, with compact transformer bobbin assemblies which meet the International Electrotechnical Committee (IEC), International Committee on Rules for the Application of Electrical Equipment (IEE), Verband Deutscher Elektrotechniker (VDE), and British Standards Institute (BSI) standards.

Manufacturing transformers to meet these standards in the past has typically resulted in transformers that are costly to produce since they are labor-intensive. The older tape wound insulation approach resulted in very thick tape layers to provide the necessary creepage and clearance distances (i.e., creepage distance is the shortest distance along the intermediate surface between two windings or leads, whereas clearance distance is the shortest distance either through air or over the intermediate surface or any combination of the two), and high voltage insulation that these standards call for, increasing the size of these transformers and the labor for manufacturing them unnecessarily. A second approach of the prior art is a bobbin and shield arrangement wherein the individual bobbins were aligned linearly with a shield between each bobbin to provide the required minimum creepage and clearance distances and high voltage insulation. Transformers of this configuration are also bulky and heavy as a result of the large amount of steel necessary for laminations since the elements are arranged linearly. The linear arrangements of the elements also result in an inefficient transformer since a large amount of the energy goes into stray fields which were not coupled to the other windings.

It would be desirable to design an isolating type transformer that meets the IEC, CEE, VDE and BSI standards which is not as bulky, is not as labor-intensive to manufacture and more efficiently couples the energy between each of the various windings. The present invention disclosed herein represents such a transformer.

In accordance with the preferred embodiment, the bobbin assembly of the present invention consists of three pieces, two primary bobbin pieces and a secondary bobbin piece. The secondary bobbin piece is designed to provide the necessary creepage and clearance distances between the individual primary windings through the inclusion of a web within its central opening midway between its two exterior surfaces and stepped external flanges. Also, the lead wire spacing of the primary leads is maintained by passing these leads through the holes provided in the outer flange of each of the primary bobbin pieces. When assembled, the two primary bobbin pieces nest within the interior opening within the secondary bobbin piece from opposite sides.

DESCRIPTION OF THE DRAWINGS

FIG. 4*b* shows a cross-sectional view of the prior art transformer bobbin assembly shown in FIG. 4*a;*

DESCRIPTION OF THE PREFERRED EMBODIMENT

Figure 4A:
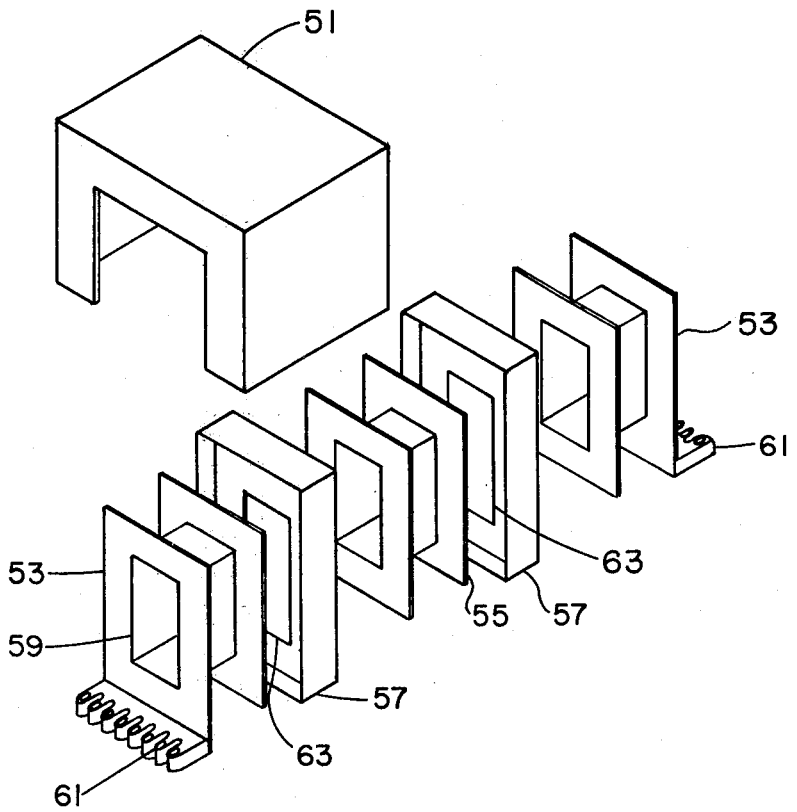
Fig. 4a (PRIOR ART)
FIG. 4*a* shows an exploded perspective view of one prior art transformer bobbin assembly.

In FIG. 4*a* there is shown a dual primary single secondary transformer bobbin assembly of the prior art which meets the current IEC, CEE, BSI and VDE standards. The prior art configuration shown here consists of six pieces. Included in this assembly are core shield 51, primary bobbin pieces 53, secondary bobbin piece 55, and primary-secondary shields 57. After primary and secondary bobbin pieces are wound, the bobbins 53 and 55, and primary-secondary shields 57 are aligned axially adjacent to each other, and core shield 51 is then placed over the entire grouping of bobbin pieces and shields, 53 through 57, to maintain their alignment and closure so that the tongue of the transformer core steel laminations can be inserted through the central hole 59 of the assembly. The wires from each of the primaries and the secondary are then dressed out to mounting feet 61 on the external flanges of the primary bobbin pieces 53 on either end of the transformer assembly.

In this prior art assembly, the creepage and clearance distances required by the standards are provided by the webbed portion 63 within each of the primary-secondary shields 57 which are adjacent to one end flange of the primary bobbin piece 53 and the secondary bobbin piece 55. It is also necessary that the transformer bobbin pieces and shields provide sufficient high voltage insulation between windings. This insulation is achieved through the selection of a suitable material from which these pieces are manufactured. This material typically is plastic, however, any suitable material could be utilized.

This configuration, while meeting the standards is lacking somewhat in efficiency and is overly bulky. The linear configuration of elements causes a reduction of the magnetic coupling between windings resulting in a larger percentage of the magnetic energy in stray fields and therefore a lower efficiency transformer.

FIG. 4*b* shows a cross-sectional view of the dual primary, single secondary transformer bobbin assembly of FIG. 4*a*. From this figure it can be seen that the minimum creepage and clearance distance between the primary and secondary winding when wound on primary bobbin piece 55 and secondary bobbin pieces 53, respectively, is twice the width of webbed portion 63 of primary-secondary shields 57, plus the thickness of web portion 63, plus the thickness of flange 65 of primary bobbin piece 53, plus the thickness of flange 67 of secondary bobbin piece 55. The minimum creepage and clearance distance between the transformer leads in this configuration is provided by the fixed spacing between mounting feet 61 on the outer flange of primary bobbin pieces 53 (FIG. 4*a*).

Figure 5:
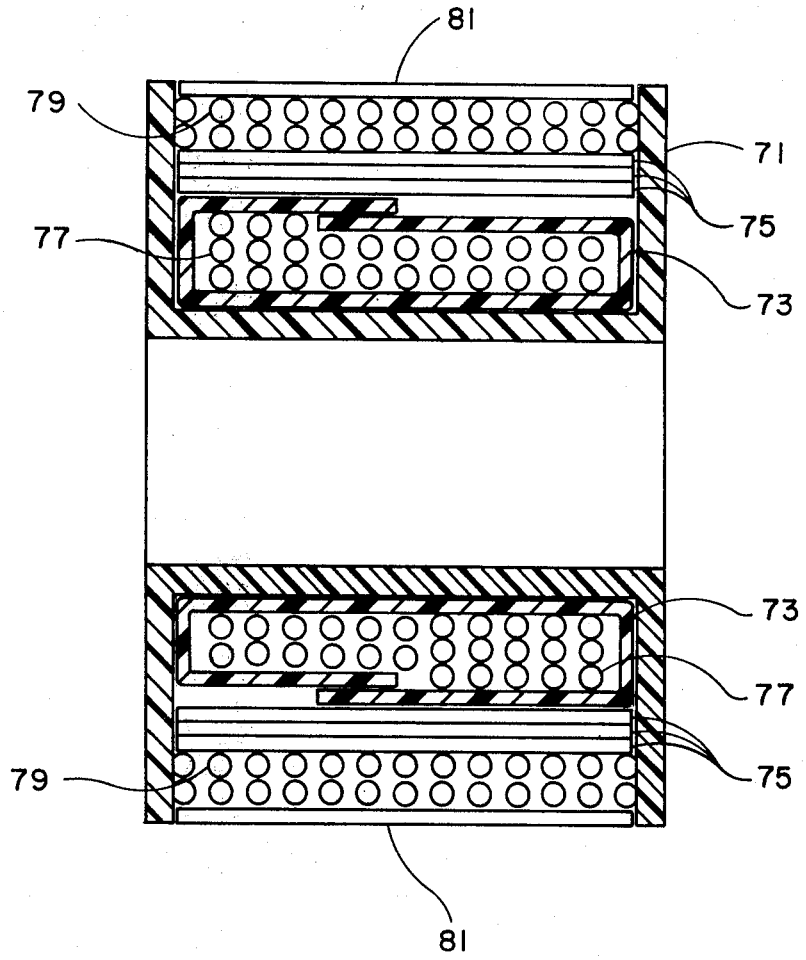
Fig. 5 (PRIOR ART)
FIG. 5 shows a cross-sectional view of the multilayer winding on a single bobbin technique of the prior art that meets the IEC, CEE, BSI, and VDE standards.

FIG. 5 shows a cross-sectional view of a transformer wound in a second prior art configuration that meets the IEC, CEE, BSI and VDE standards. This transformer includes bobbin 71, a primary winding 77 which is completely wrapped by tape 73. The manner in which tape 73 is wrapped around primary winding 77 is commonly known as mummy wrapping. Tape 73 in this mummy wrap configuration next must be closed off with several turns of tape and is shown in FIG. 5 with $3\frac{1}{2}$ wraps of tape 75. Next, the secondary winding 79 is wound on bobbin 71 over tape 75. Then the secondary windings 79 is wrapped with tape layer 81. To finalize the transformer, the core laminations (not shown) are added as in other transformers. This approach to transformer manufacturing is very labor-intensive and, therefore, very costly.

Figure 1:
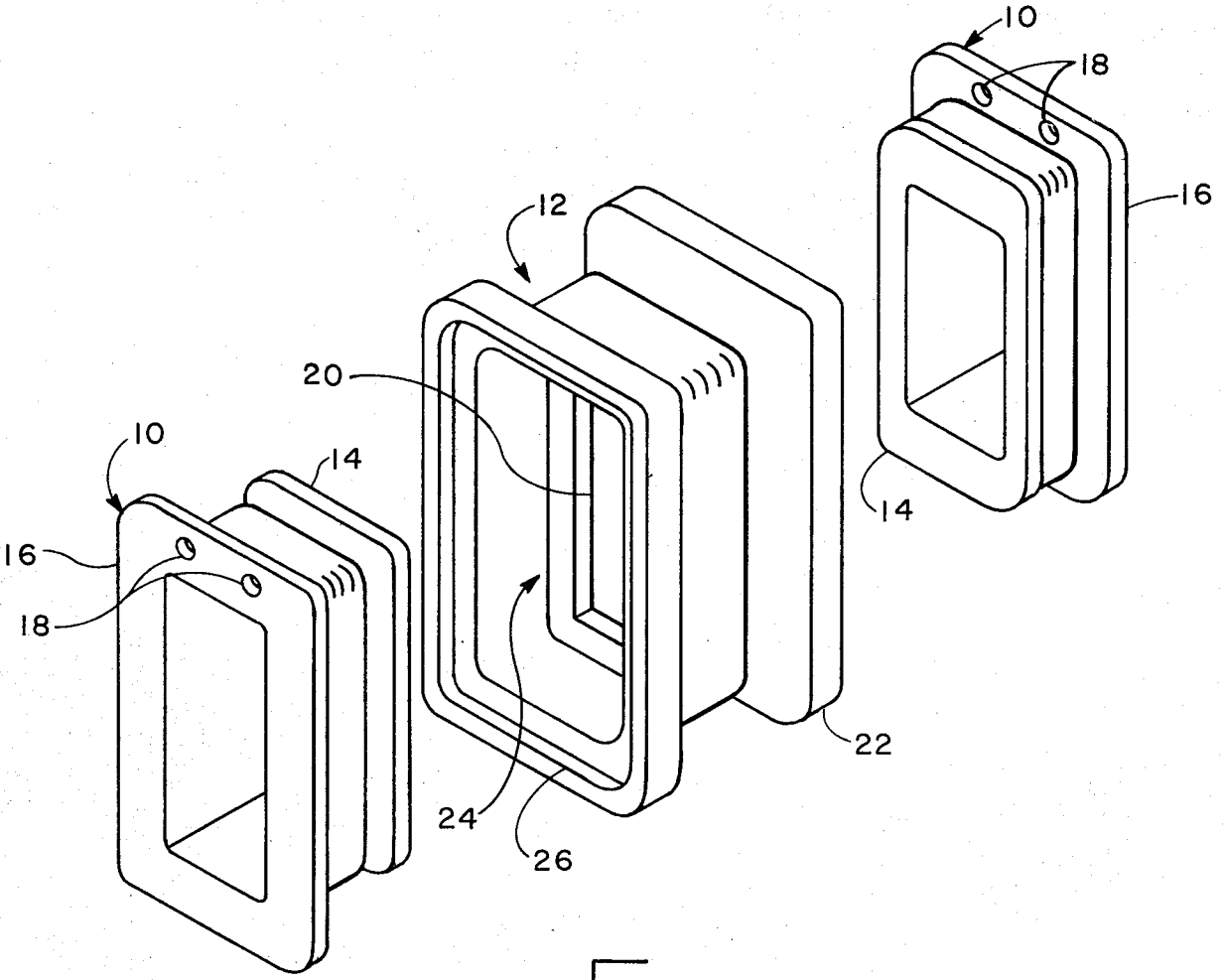
FIG. 1 shows an exploded perspective view of the three piece transformer bobbin of the present invention.

The present invention is shown in FIG. 1 having three pieces; two primary bobbin pieces 10 and a secondary bobbin piece 12. In this configuration, the primary coils are wound on primary bobbin pieces 10 between a smaller inner flange 14 and a larger outer flange 16 with the ends of the windings protruding through holes 18 in outer flange 16. The secondary winding is wound around secondary bobbin piece 12 between end flanges 22. After primary bobbin pieces 10 are wound, they are nested within secondary bobbin piece 12. This is possible since the interior of secondary bobbin piece 12 is dimensioned to accommodate inner flange 14 of primary bobbin pieces 10 within interior opening 24. Secondary bobbin piece 12 is designed to fully accommodate the primary bobbin pieces 10 from opposite ends resulting in secondary bobbin piece 12 being substantially equal to twice the width of the primary windings. Once in place, inner flange 14 is adjacent to web 20 within secondary bobbin piece 12. The external flange on each of primary winding bobbin pieces 10 then abuts the outer surface of flanges 22 on secondary bobbin piece 12 fitting within the recessed area 26 provided on the outer surface of flanges 22 closing the assembly.

In this configuration the necessary creepage and clearance distances between the two primary windings is provided by web 20 located centrally within secondary bobbin piece 12 adjacent to which inner flange 14 of each primary pieces 10, and between each primary winding and the secondary winding external flanges 22 on secondary bobbin piece 12. In other words, the creepage and clearance distance between the two primary windings is twice the height plus the wall thickness of web 20 plus the thickness of flange A or 2E plus F plus 2H (see FIG. 2) between each primary winding and the secondary winding is the sum of distances A, B, C and D (see FIG. 2), between the primary leads is the fixed spacing between holes 18, and between the primary leads and the transformer core is distance G. The necessary high voltage insulation is provided through the proper choice of the material of the bobbins as it was in the prior art.

Figure 2:
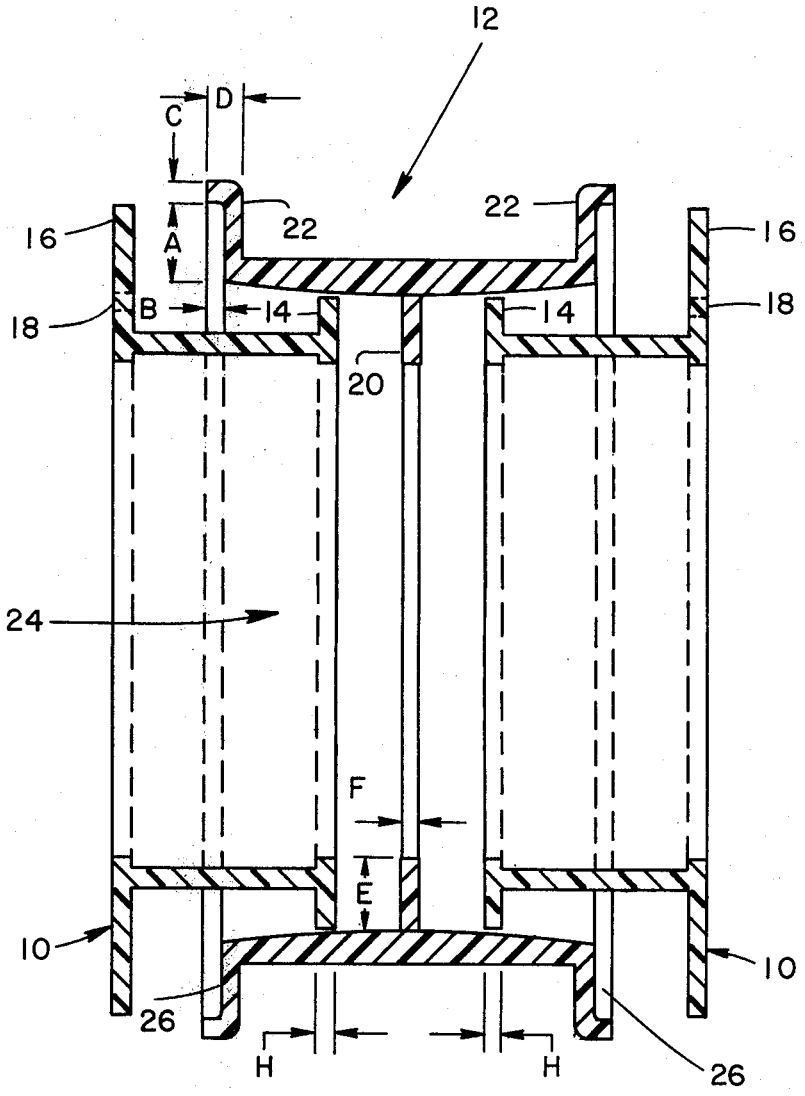
FIG. 2 shows a cross-sectional view of the three piece transformer bobbin assembly of the present invention.

In FIG. 2, there is shown a cutaway view of the three bobbin pieces of the current invention with primary bobbin pieces 10 partially inserted within the central opening 24 of secondary bobbin piece 12. In this figure it can be seen that secondary bobbin piece 12 is approximately twice as wide as each primary bobbin piece 10. Further it can be seen that when primary bobbin pieces 10 are fully inserted within secondary bobbin piece 12, inner flange 14 is adjacent to web 20. Additionally, external flange 16 on each of primary bobbin piece 10 fits within recess 26 of flanges 22 on secondary bobbin piece 12. In this view the material is cross hatched to show that it is made of plastic, however, the bobbin pieces can be made from any suitable material.

Figure 3:
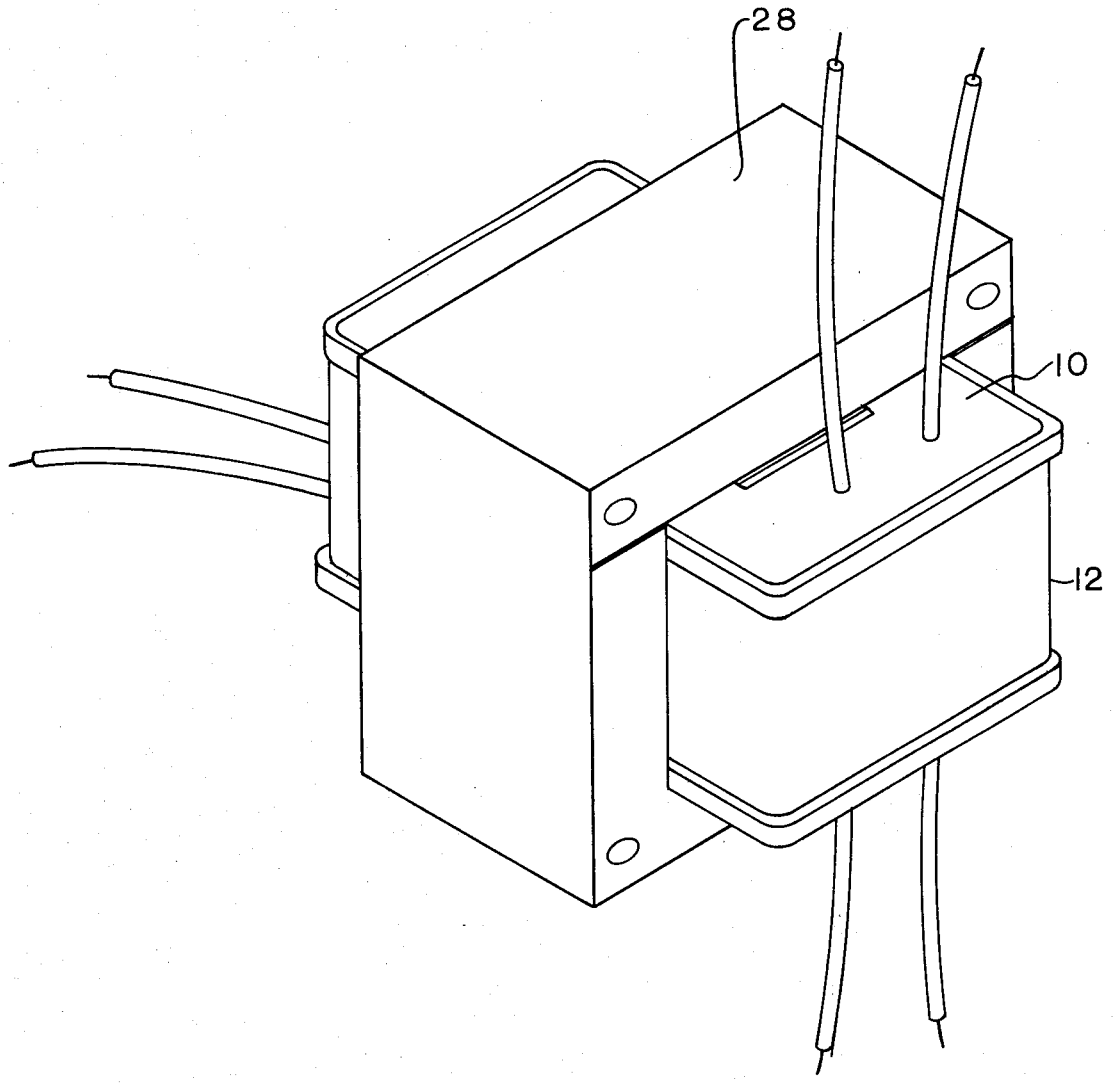
FIG. 3 shows a perspective view of an transformer constructed with the bobbin pieces of the present invention.

When the three windings are complete and primary bobbin pieces 10 are inserted within secondary bobbin piece 12, the transformer is completed by wrapping the exterior surface of the secondary windings and inserting steel laminations 28 with the tongue through interior opening 24 and extending through all three of bobbin pieces 10 and 12 as shown in FIG. 3. This configuration provides a more compact transformer assembly, eliminates the necessity of tape wrapping each layer of windings and provides a more efficient coupling of the magnetic fields between the various windings since the primary windings are physically located within the secondary winding. This design lends itself to both high and low voltage transformers, as well as, high and low frequency transformers and minimizes the overall size of the finished device. In addition, by simplifying the design, i.e., reducing the number of pieces, the cost of manufacturing the device is substantially lowered and the amount of labor required to assemble the device is decreased.

We claim:

1. A transformer bobbin assembly for providing the necessary creepage and clearance distances and electrical insulation between each of the windings of a finished transformer, the bobbin assembly comprising:

a single first bobbin piece being a continuous single piece of selected electrically insulating material defining a first interior cavity along its central axis therethrough; and a pair of second bobbin pieces each being a continuous single piece of a selected electrically insulating material each defining a second interior cavity along their central axis therethrough and dimensioned for nesting by direct insertion within the cavity of the first bobbin piece;

said first bobbin piece further including a first pair of flanges to define a channel to accommodate a coil winding, said first pair of flanges being dimensioned so that the surface distance from, and perpendicular to, the loci of points that define the end of the interior cavity of said first bobbin piece to the top of the flange at the end of the first bobbin piece plus the thickness of the flange provides at least the minimum creepage and clearance distances required between the coils to be wound on the first and second bobbin pieces;

each of said second bobbin pieces further including second pair of flanges to define a channel to accommodate a coil winding, one of each said second pair of flanges further defining at least two holes through the flange, said holes each having its axis parallel to the central axis of the second bobbin piece and dimensioned to allow the ends of said coil winding to pass through and to maintain at least the minimum creepage and clearance distances required;

the coil winding channel of said second bobbin pieces being substantially fully encircled by a portion of the coil winding channel of said first bobbin piece when each of said second bobbin pieces is nested within said first bobbin piece; and said first bobbin piece further having a web means located perpendicularly to its central axis within its interior cavity and having a substantially uniform height to define a hole therethrough that has substantially the same shape and at least the same size as the interior cavity through the second bobbin pieces, the height and thickness of the web means being selected so that twice its height plus its thickness provides at least the minimum creepage and clearance distances required between the coil windings to be wound on the second bobbin pieces.

* * * * *